US006436166B2

(12) United States Patent
Arvidsson et al.

(10) Patent No.: US 6,436,166 B2
(45) Date of Patent: Aug. 20, 2002

(54) POWDER COMPOSITION

(75) Inventors: Johan Arvidsson, Viken; Hilmar Vidarsson, Höganäs, both of (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/768,603

(22) Filed: Jan. 25, 2001

Related U.S. Application Data

(63) Continuation of application No. PCT/SE00/01724, filed on Sep. 7, 2000.

(30) Foreign Application Priority Data

Sep. 9, 1999 (SE) ..... 9903231

(51) Int. Cl.[7] ..... B22F 1/00

(52) U.S. Cl. ..... 75/252; 75/255; 419/36

(58) Field of Search ..... 75/252, 255; 419/36

(56) References Cited

U.S. PATENT DOCUMENTS

| | | | | |
|---|---|---|---|---|
| 4,946,499 A | 8/1990 | Sakuranda et al. | ..... | 75/343 |
| 5,782,954 A | 7/1998 | Luk | ..... | 75/252 |

FOREIGN PATENT DOCUMENTS

| | | |
|---|---|---|
| EP | 0 580 681 B1 | 5/1997 |
| JP | 58-193302 | 11/1983 |
| JP | 1-219101 | 9/1989 |
| WO | WO 99/59753 A1 | 11/1999 |

*Primary Examiner*—Ngoclan Mai
(74) *Attorney, Agent, or Firm*—Burns, Doane, Swecker, & Mathis, LLP

(57) ABSTRACT

The present invention concerns powder compositions including iron-containing powders, additives, lubricant and flow agents. The powder compositions essentially consist of iron-containing particles having additive particles bonded thereto by a molten and subsequently solidified lubricant for the formation of aggregate particles and from about 0.005 to about 2 percent by weight of a flow agent having a particle size below 200 nanometers.

29 Claims, No Drawings

POWDER COMPOSITION

This is a Continuation of International Application No. PCT/SE00/01724, filed Sep. 7, 2000, that designates the United States of America and was published under PCT Article 21(2) in English and claims priority for Swedish Application No. 9903231-0, filed Sep. 9, 1999.

The present invention relates to a powder mixture and a method for the production thereof. More particularly, the invention relates to an iron-based powder mixture for use in powder metallurgy.

Powder metallurgy is a well-established technique used for the production of various components for e.g. the motor industry. In the production of components, a powder mixture is compacted and sintered so as to provide a part of any desired shape. The powder mixture comprises a base metal powder as the main component and admixed, pulverulent additives. The additives can be, for example, graphite, Ni, Cu, Mo, MnS, $Fe_3P$ etc. For reproducible production of the desired products by using powder metallurgical techniques, the powder composition used as starting material must be as homogeneous as possible. This is usually achieved in that the components of the composition are homogeneously intermixed. Since the pulverulent components of the composition differ in size, density and shape, there will however be problems with the homogeneity of the composition.

Thus segregation occurs during the transport and handling of the powder composition because powder components of higher density and smaller size than the base metal powder tend to collect towards the lower part of the composition, whereas powder components of lower density tend to rise to the upper part of the composition. This segregation implies that the composition will be non-uniformly composed, which in turn means that parts made of the powder composition are differently composed and consequently have different properties. A further problem is that fine particles, particularly those of lower density such as graphite, cause dusting in the handling of the powder mixture.

In general, the additives are powders having a smaller particle size than the base metal powder. While the base metal powder thus has a particle size smaller than about 150 $\mu$m, most additives have a particle size smaller than about 20 $\mu$m. This smaller particle size results in an increased surface area of the composition, which in turn implies that its flowing properties, i.e. its capacity of flowing as a free-flowing powder, are impaired. The impaired flow manifests itself in increased time for filling dies with powder, which means lower productivity and an increased risk of variations in density in the compacted component, which may lead to unacceptable deformations after sintering.

Attempts have previously been made at solving the problems described above by adding different binders and lubricants to the powder composition. The purpose of the binder is to bind firmly and effectively the particles of additives, such as alloying components, to the surface of the base metal particles and, consequently, reduce the problems of segregation and dusting. The purpose of the lubricant is to reduce the friction of the powder composition and thus increase the flow thereof and also reduce the ejection force, i.e. the force required to eject the finally compacted product from the die.

One object of the present invention is to try to reduce or eliminate the problems described above in connection with the prior art technique. In particular, the object of the invention is to provide a powder metallurgical mixture or composition accompanied by reduced segregation and dusting. A second object is to provide a powder mixture having satisfactory flow. A third object is to provide a powder mixture for compaction at ambient temperature (cold compaction) and a forth object is to provide methods adapted for large-scale production of such powder compositions. A fifth object is to eliminate the use of conventional binders and solvents.

According to the present invention these problems are reduced or eliminated by a powder composition prepared by a process including the steps of

- mixing and heating an iron-containing powder, a pulverulent additive and a pulverulent lubricant to a temperature above the melting point of the lubricant,
- cooling the obtained mixture to a temperature below the melting point of the lubricant for a period of time sufficient to solidify the lubricant and bind the additive particles to the iron-containing particles in order to form aggregate particles, and
- mixing a pulverulent flow agent having a particle size below 200 nanometers, preferably below 40 nanometers, with the obtained mixture in an amount between 0.005 to about 2% by weight of the composition.

Powder mixtures involving the melting and subsequent solidifying of binders and/or lubricants, i.e. the so-called melt-bonding technique, is known from e.g. the U.S. Pat. No. 4,946,499, which discloses an iron-based powder mixture with a binder which is a combination of an oil and a metal soap or a wax which are molten together. When producing the composition according to this patent publication, the powder is mixed with the metal soap or the wax, and oil, and the mixture is heated so that the oil and the metal soap or wax melt together, whereupon the mixture is cooled. The published JP application Publication No. 58-193302 discloses the use of a pulverulent lubricant, such as zinc stearate, as a binder. The pulverulent lubricant is added to the powder composition and heated to melting during continued mixing, whereupon the mixture is cooled. The published JP application Publication No. 1-219101 also discloses the use of a lubricant as a binder. When producing a powder composition, metal powder is mixed with a lubricant and heated above the melting point of the lubricant, whereupon cooling is effected.

The EP patent 580 681 discloses an iron-based metallurgical powder composition including a base iron powder, pulverulent additives a binder, a diamide wax, preferably ethylene-bis-stearamide, and optionally a pulverulent lubricant wherein the binder is present in molten and subsequently solidified form for binding together the powder particles of the additives with the powder particles of the base metal.

The use of flow agents is disclosed in U.S. Pat. No. 5,782,954. This patent discloses iron-based metallurgical powder compositions that contain nanoparticle metal or metal oxide flow agents useful for enhancing the flow characteristics of the compositions, particularly at elevated processing temperatures. The iron-based powder compositions which, in addition to iron and alloying elements include binder(s) and high temperature lubricant, can be advantageously blended with a flow agent such as a silicon oxide or iron oxide, or a combination of both, to provide a powder composition having improved flow properties.

The flow agent used according to the present invention is preferably a silicon oxide, most preferably silicon dioxide having an average particle size of below about 40, preferably from about 1–35 nanometers and it is used in an amount from about 0.005 to about 2, preferably 0.01–1 percent by weight, most preferably from 0.025 to 0.5 percent by weight of the total composition. Other metals that can be used as flow agents in either its metal or metaloxide forms include aluminium, copper, iron, nickel, titanium, gold, silver, platinum, palladium, bismuth, cobalt, manganese, lead, tin, vanadium, yttrium, niobium, tungsten and zirconium with a particle size of less than 200 nm.

The iron-containing powder may be an essentially pure iron powder or a mixture of different iron-powders which is admixed with the pulverulent additives. The powder may also be a pre-alloyed powder or a diffusion or partially alloyed powder.

The additives may be commonly used alloying elements such as graphite, ferrophorsorus and hard phase materials, such as carbides and nitrides. The iron-containing powder may contain admixed alloying elements such as Cu, Ni, Mo, graphite, $Fe_3P$, and MnS in amounts up to 10%.

The lubricants may be selected from waxes, metal soaps and thermoplastic materials. Examples of waxes are diamide waxes, such as ethylene-bis-stearamide. Examples of metal soaps are zinc stearate, lithium stearate and examples of thermoplastic materials are polyamides, polyimides, polyolefins, polyesters, polyalkoxides, polyalcohols.

The lubricants may be used in amounts between 0.05 and 3%, preferably between 0.2 and 2% and most preferably between 0.5 and 1.5% by weight of the composition. A mixture of lubricants may also be used, wherein at least one of the lubricants melts during the process. Below about 0.05% by weight of lubricant results in unsatisfactory binding, whereas above about 2% by weight of lubricant results in undesired porosity of the final product. Within the limits set, the amount of lubricant is selected according to the amount of additives, a larger amount of additives requiring a larger amount of lubricant and vice versa.

According to a preferred embodiment the pulverulent flow agent is added to the mixture of the iron containing particles having the additive particles bonded thereto by the solidified lubricant at a temperature higher than ambient temperature but below the melting temperature of the lubricant, e.g. within a range of 10 to 30° C. below the melting point of the lubricant. In this case the flow agent may be added to the aggregate powder before the ambient temperature has been reached.

The powder mixes according to the invention are intended for the preparation of compacted and sintered components under standard conditions. Thus the compaction is performed at ambient temperature ("cold compaction") at pressures between 400 and 1000 MPA and the sintering is performed at temperatures between 1050 and 1200° C. Alternatively the compaction may be performed at elevated temperatures.

The process for the preparation of the powder mixes may be performed batch-wise or continuously. Specific advantages by the continuous preparation are the possibility to obtain a smooth and even flow which in turn leads to more homogenous products.

The invention also concern powder compositions including iron-containing powders, additives, lubricants and flow agent wherein the composition essentially consists of the iron-containing particles having the additives bonded thereto by a molten and subsequently solidified lubricant for the formation of aggregate particles and from about 0.005 to about 2 percent by weight of the flow agent having a particle size below 200 nanometers, preferably below 40 nanometers.

When carrying out the method according to the invention it is important that the components of the mixture, including the lubricant, are homogeneously intermixed. This is achieved by mixing in a mixing device the base iron powder and the pulverulent additives, such as graphite, Cu etc, and the pulverulent lubricant until a homogeneous powder mixture is obtained. During continued mixing, the mixture is then heated until the lubricant melts, which for most presently used lubricants occurs at about 90°–170° C. in air, preferably at about 120°–150° C. The lubricant should not have a too high melting point, thereby minimising the amount of energy required to heat the powder mixture so that the lubricant melts. Therefore, an upper limit of the melting point of the lubricant has been set at a temperature of about 170° C.

When the molten lubricant has been uniformly distributed in the mixture during the mixing operation, the mixture is cooled to make the lubricant solidify and, thus, exert its binding effect between the base iron particles and the smaller particles of additives, such as graphite, Cu, Ni, Mo, MnS, $Fe_3$ P etc, which are arranged on the surface thereof. It is important that also the cooling operation is performed during mixing, thereby maintaining the homogeneity of the mixture. The mixing during cooling need not, however, be as powerful as the preceding mixing for the provision of a homogeneous mixture. When the lubricant has solidified, the powder mixture is homogeneously mixed with the flow agent before it is ready to use. Preferably the flow agent is added to the aggregate particles of iron and additive while the aggregate surface still retains its possibility to adhere or bind the particles of the flow agent, i.e. while the surface is still warm.

Optionally, an additional lubricant may be added to the powder mixture after the lubricant has solidified and the flow agent has been intermixed. However, this is not mandatory.

To facilitate the understanding of the invention, it will be illustrated below by means of a non-restrictive example.

In the tests described in the example, the following materials and methods have been used.

As base metal powder, atomised iron powder was used, having an average particle diameter of about 63 $\mu$m, all particles being smaller than 150 $\mu$m.

As additives, powders of copper (Cu) and graphite were used, the Cu-powder having an average particle size of about 200 mesh and the graphite powder an average particle size of about 4 $\mu$m.

The mixing of the powder mixtures was effected in two steps, the components of the mixture first being premixed with each another in a mixing device, type Lodige, supplied by Gebr. Lodige Maschinenbau GmbH, W-4790 Paderborn, Germany, for 2 min, whereupon the resulting mixture was transferred to a cylindrical mixing device having a height of about 300 mm and a diameter of about 80 mm and provided with a double helix mixer and a heating jacket with adjustable heating. In the cylindrical mixing device the powder was agitated and heated to about 150° C. about 15 min to melt the lubricant. The temperature was then kept at about 150° C. during continued agitation for about 3 min, whereupon the heat was shut off and the mixture was allowed to cool to about 120° C. during agitation before the flow agent was added. The mixture was then subjected to continued cooling before the mixture was emptied out. The flow of the powder mixtures was measured according to Swedish Standard SS 111031, which corresponds to International Standard ISO 4490-1978.

The apparent density (AD) of the powder mixtures was measured according to Swedish Standard SS 111030 which corresponds to ISO 3923/1-1979.

The dusting of the powder mixtures was measured as the number of counts per minute at a given flow of air by means of an apparatus, type Dust Track.

Various powder mixtures were produced in the manner which has been generally described above, the composition thereof being as follows:

| Composition | % by weight |
|---|---|
| ASC 100.29* | 96.70 |
| Cu | 2.00 |
| C | 0.50 |
| H-wax** | 0.80 |

*available from Höganäs AB, Sweden
**available from Hoechst AG, Germany

| Mixture | Flow/s/50 g) | AD (g/cm3) | Filling index (%) | Dusting* |
|---|---|---|---|---|
| Powder composition | 32.10 | 3.03 | 8.13 | 370 |
| +0 | 29.23 | 3.02 | 6.48 | 116 |
| +0.03 * (150° C.) | 29.42 | 2.86 | 6.33 | 27 |
| +0.03 * (120° C.) | 26.08 | 2.92 | 4.24 | 13 |
| +0.03 * (RT) | 27.68 | 2.80 | 5.33 | 274 |

*% by weight of Aerosil R 812 available from Degussa, Germany and having a particle size of about 7 nm.

From the tests and what has besides been said above, it thus is obvious that the technique according to the invention provides powder metallurgical mixtures having good flow and a low degree of segregation and dusting.

What is claimed is:

1. A powder composition comprising iron-containing particles having particles of additives bonded thereto by a molten and subsequently solidified lubricant for the formation of aggregate particles and from about 0.005 to about 2 percent by weight of a flow agent having a particle size below 200 nanometers.

2. The powder composition according to claim 1, wherein the amount of the flow agent is 0.01–1 percent by weight.

3. The powder composition according to claim 1, wherein the flow agent is selected from the group consisting of the metals aluminium, copper, iron, nickel, titanium, gold, silver, platinum, palladium, bismuth, cobalt, manganese, lead, tin, vanadium, yttrium, niobium, tungsten and zirconium and metal oxides of the metals.

4. The powder composition according to claim 1, wherein the flow agent is silicon dioxide.

5. The powder composition according to claim 4, wherein the particle size of silicon dioxide is less than 40 nm.

6. The powder composition according to claim 1, wherein the particle size of the flow agent is from about 1 to 35 nanometers.

7. The powder composition according to claim 1, wherein the lubricant comprises a mixture of lubricants, and at least one of the lubricants melts during the formation of the aggregate particles.

8. The powder composition according to claim 1, wherein the iron-containing particles comprises particles of iron pre-alloyed with at least one alloying element.

9. The powder composition according to claim 1, wherein the iron-containing powder comprises particles of iron diffusion bonded with at least one alloying element.

10. The powder composition according to claim 1, wherein the iron-containing powder comprises particles of substantially pure iron.

11. The powder composition according to claim 8, wherein the lubricant is selected from the group consisting of graphite, ferrophosphorus and hard phase materials.

12. The powder composition according to claim 1, wherein the lubricant is selected from the group consisting of waxes, metal soaps and thermoplastic materials.

13. The powder composition according to claim 12, wherein the thermoplastic material is selected from the group consisting of polyamides, polyimides, polyolefins, polyesters, polyalkoxides, polyalcohols.

14. The powder composition according to claim 1, wherein the amount of the lubricant is between 0.05 and 3% by weight of the composition.

15. The powder composition according to claim 1, wherein the lubricant is suitable for cold compaction of the powder composition.

16. The powder composition according to claim 1, wherein the lubricant comprises zinc stearate and/or ethylene-bis-stearamide.

17. The powder composition according to claim 1, wherein at least a part of the particles of the flow agent are adhered to the aggregate particles.

18. A process for the preparation of powder compositions for the preparation of powder metallurgical components, the process including the steps of:

mixing and heating an iron-containing powder, a pulverulent additive and a pulverulent lubricant to a temperature above the melting point of the lubricant;

cooling the obtained mixture to a temperature below the melting point of the lubricant for a period of time sufficient to solidify the lubricant and bind the additive particles to the iron-containing particles in order to form aggregate particles; and mixing a pulverulent flow agent having a particle size below 200 nanometers with the obtained mixture in an amount between 0.005 to about 2% by weight of the composition.

19. The process according to claim 18, wherein the particle size of the flow agent is less than 40 nm.

20. The process according to claim 18, wherein the flow agent is added and mixed with the aggregate powder at an elevated temperature for adhering at least a part of the particles of the flow agent to the particles of the aggregate powder.

21. The process according to claim 18, wherein the flow agent is added and mixed with the aggregate powder at a temperature 10–30° C. below the melting point peak of the lubricant.

22. The process according to claim 18, wherein the process is performed as a continuous process.

23. The powder composition according to claim 2, wherein the flow agent is selected from the group consisting of the metals aluminum, copper, iron, nickel, titanium, gold, silver, platinum, palladium, bismuth, cobalt, manganese, lead, tin, vanadium, yttrium, niobium, tungsten and zirconium and metal oxides of the metals.

24. The powder composition according to claim 2, wherein the flow agent is silicon dioxide.

25. The process according to claim 19, wherein the flow agent is added and mixed with the aggregate powder at an elevated temperature for adhering at least a part of the particles of the flow agent to the particles of the aggregate powder.

26. The powder composition according to claim 1, wherein the amount of the flow agent is 0.025 to 0.5 percent by weight.

27. The powder composition according to claim 1, wherein the amount of the lubricant if between 0.2 and 2% by weight of the composition.

28. The powder composition according to claim 1, wherein the amount of the lubricant is between 0.5 and 1.5% by weight of the composition.

29. The powder composition according to claim 1, which consists essentially of the iron-containing powder, additive, lubricant and flow agent.

* * * * *